US010278247B2

(12) United States Patent
Ivey et al.

(10) Patent No.: US 10,278,247 B2
(45) **Date of Patent: *Apr. 30, 2019**

(54) SYSTEM AND METHOD FOR CONTROLLING OPERATION OF AN LED-BASED LIGHT

(71) Applicant: iLumisys, Inc., Troy, MI (US)

(72) Inventors: John Ivey, Farmington Hills, MI (US); David L. Simon, Grosse Pointe Woods, MI (US); Hoan Ngo, Sterling Heights, MI (US); Anthony J. Norton, Ann Arbor, MI (US); Brian Nickol, Macomb, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/712,701

(22) Filed: Sep. 22, 2017

(65) Prior Publication Data

US 2018/0027625 A1 Jan. 25, 2018

Related U.S. Application Data

(63) Continuation of application No. 15/008,864, filed on Jan. 28, 2016, now Pat. No. 9,807,842, which is a continuation of application No. 13/934,607, filed on Jul. 3, 2013, now Pat. No. 9,271,367.

(60) Provisional application No. 61/669,319, filed on Jul. 9, 2012.

(51) Int. Cl.
*H05B 33/08* (2006.01)
*H05B 37/02* (2006.01)

(52) U.S. Cl.
CPC ..... *H05B 33/0854* (2013.01); *H05B 33/0803* (2013.01); *H05B 37/029* (2013.01); *H05B 37/0245* (2013.01); *H05B 37/0272* (2013.01)

(58) Field of Classification Search
CPC ..... H05B 33/0854; H05B 33/0845; H05B 33/08; H05B 33/0833; H05B 33/0803; H05B 37/0272; H05B 37/0245; H05B 37/0227; H05B 39/00; H05B 39/02; H04L 12/1845; H04L 29/12254; H04L 61/2038; H04W 4/02
See application file for complete search history.

(56) References Cited

U.S. PATENT DOCUMENTS

| | | | |
|---|---|---|---|
| 2,826,679 | A | 3/1958 | Rosenburg |
| 2,909,097 | A | 10/1959 | Alden et al. |
| 3,178,622 | A | 4/1965 | Paul et al. |
| 3,272,977 | A | 9/1966 | Holmes |
| 3,318,185 | A | 5/1967 | Hermann |
| 3,561,719 | A | 2/1971 | Grindle |
| 3,586,936 | A | 6/1971 | McLeroy |

(Continued)

*Primary Examiner* — Tung X Le
*Assistant Examiner* — Henry Luong
(74) *Attorney, Agent, or Firm* — Fish & Richardson P.C.

(57) ABSTRACT

For controlling operation of a light source, a method of associating a light source with an area for which the light source is positioned to provide lighting comprises: identifying, based on a determined physical position of a light source, one of a plurality of areas as the area for which the light source is positioned to provide lighting; identifying at least one desired lighting condition for the identified area; and controlling, using a processor, operation of the light source based on the identified at least one desired lighting condition for the identified area.

6 Claims, 3 Drawing Sheets

(56) References Cited

U.S. PATENT DOCUMENTS 3,601,621 A 8/1971 Ritchie
3,612,855 A 10/1971 Juhnke
3,643,088 A 2/1972 Osteen et al.
3,739,336 A 6/1973 Burland
3,746,918 A 7/1973 Drucker et al.
3,818,216 A 6/1974 Larraburu
3,832,503 A 8/1974 Crane
3,858,086 A 12/1974 Anderson et al.
3,909,670 A 9/1975 Wakamatsu et al.
3,924,120 A 12/1975 Cox, III
3,958,885 A 5/1976 Stockinger et al.
3,969,720 A 7/1976 Nishino
3,974,637 A 8/1976 Bergey et al.
3,993,386 A 11/1976 Rowe
4,001,571 A 1/1977 Martin
4,054,814 A 10/1977 Fegley et al.
4,070,568 A 1/1978 Gala
4,082,395 A 4/1978 Donato et al.
4,096,349 A 6/1978 Donato
4,102,558 A 7/1978 Krachman
4,107,581 A 8/1978 Abernethy
4,189,663 A 2/1980 Schmutzer et al.
4,211,955 A 7/1980 Ray
4,241,295 A 12/1980 Williams, Jr.
4,261,029 A 4/1981 Mousset
4,262,255 A 4/1981 Kokei et al.
4,271,408 A 6/1981 Teshima et al.
4,271,458 A 6/1981 George, Jr.
4,272,689 A 6/1981 Crosby et al.
4,273,999 A 6/1981 Pierpoint
4,298,869 A 11/1981 Okuno
4,329,625 A 5/1982 Niskizawa et al.
4,339,788 A 7/1982 White et al.
4,342,947 A 8/1982 Bloyd
4,344,117 A 8/1982 Niccum
4,367,464 A 1/1983 Kurahashi et al.
4,382,272 A 5/1983 Quelle et al.
4,388,567 A 6/1983 Yamazaki et al.
4,388,589 A 6/1983 Molldrem, Jr.
4,392,187 A 7/1983 Bornhorst
4,394,719 A 7/1983 Moberg
4,420,711 A 12/1983 Takahashi et al.
4,455,562 A 6/1984 Dolan et al.
4,500,796 A 2/1985 Quin
4,521,835 A 6/1985 Meggs et al.
4,531,114 A 7/1985 Topol et al.
4,581,687 A 4/1986 Nakanishi
4,597,033 A 6/1986 Meggs et al.
4,600,972 A 7/1986 MacIntyre
4,607,317 A 8/1986 Lin
4,622,881 A 11/1986 Rand
4,625,152 A 11/1986 Nakai
4,635,052 A 1/1987 Aoike et al.
4,647,217 A 3/1987 Havel
4,650,971 A 3/1987 Manecci et al.
4,656,398 A 4/1987 Michael et al.
4,661,890 A 4/1987 Watanabe et al.
4,668,895 A 5/1987 Schneiter
4,669,033 A 5/1987 Lee
4,675,575 A 6/1987 Smith et al.
4,682,079 A 7/1987 Sanders et al.
4,686,425 A 8/1987 Havel
4,687,340 A 8/1987 Havel
4,688,154 A 8/1987 Nilssen
4,688,869 A 8/1987 Kelly
4,695,769 A 9/1987 Schweickardt
4,698,730 A 10/1987 Sakai et al.
4,701,669 A 10/1987 Head et al.
4,705,406 A 11/1987 Havel
4,707,141 A 11/1987 Havel
4,727,289 A 2/1988 Uchida
4,739,454 A 4/1988 Federgreen
4,740,882 A 4/1988 Miller
4,748,545 A 5/1988 Schmitt
4,753,148 A 6/1988 Johnson
4,758,173 A 7/1988 Northrop
4,765,708 A 8/1988 Becker et al.
4,771,274 A 9/1988 Havel
4,780,621 A 10/1988 Bartleucc et al.
4,794,373 A 12/1988 Harrison
4,794,383 A 12/1988 Havel
4,801,928 A 1/1989 Minter
4,810,937 A 3/1989 Havel
4,818,072 A 4/1989 Mohebban
4,824,269 A 4/1989 Havel
4,837,565 A 6/1989 White
4,843,627 A 6/1989 Stebbins
4,845,481 A 7/1989 Havel
4,845,745 A 7/1989 Havel
4,847,536 A 7/1989 Lowe et al.
4,851,972 A 7/1989 Altman
4,854,701 A 8/1989 Noll et al.
4,857,801 A 8/1989 Farrell
4,863,223 A 9/1989 Weissenbach et al.
4,870,325 A 9/1989 Kazar
4,874,320 A 10/1989 Freed et al.
4,887,074 A 12/1989 Simon et al.
4,894,832 A 1/1990 Colak
4,901,207 A 2/1990 Sato et al.
4,904,988 A 2/1990 Nesbit et al.
4,912,371 A 3/1990 Hamilton
4,920,459 A 4/1990 Rothwell et al.
4,922,154 A 5/1990 Cacoub
4,929,936 A 5/1990 Friedman et al.
4,934,852 A 6/1990 Havel
4,941,072 A 7/1990 Yasumoto et al.
4,943,900 A 7/1990 Gartner
4,962,687 A 10/1990 Belliveau et al.
4,965,561 A 10/1990 Havel
4,973,835 A 11/1990 Kurosu et al.
4,977,351 A 12/1990 Bavaro et al.
4,979,081 A 12/1990 Leach et al.
4,979,180 A 12/1990 Muncheryan
4,980,806 A 12/1990 Taylor et al.
4,991,070 A 2/1991 Stob
4,992,704 A 2/1991 Stinson
5,003,227 A 3/1991 Nilssen
5,008,595 A 4/1991 Kazar
5,008,788 A 4/1991 Palinkas
5,010,459 A 4/1991 Taylor et al.
5,018,054 A 5/1991 Ohashi et al.
5,027,037 A 6/1991 Wei
5,027,262 A 6/1991 Freed
5,032,960 A 7/1991 Katoh
5,034,807 A 7/1991 Von Kohorn
5,036,248 A 7/1991 McEwan et al.
5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen

(56) References Cited

U.S. PATENT DOCUMENTS 5,254,910 A 10/1993 Yang
5,256,948 A 10/1993 Boldin et al.
5,278,542 A 1/1994 Smith et al.
5,281,961 A 1/1994 Elwell
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,341,988 A 8/1994 Rein et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,781,108 A 7/1998 Jacob et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,810,463 A 9/1998 Small
5,812,105 A 9/1998 Kawahara et al.
5,813,751 A 9/1998 Van de Ven
5,813,753 A 9/1998 Shaffer
5,821,695 A 9/1998 Vriens et al.
5,825,051 A 10/1998 Vilanilam et al.
5,828,178 A 10/1998 Bauer et al.
5,831,522 A 10/1998 York et al.
5,836,676 A 11/1998 Weed et al.
5,841,177 A 11/1998 Komoto et al.
5,848,837 A 11/1998 Ando et al.
5,850,126 A 12/1998 Gustafson
5,851,063 A 12/1998 Kanbar
5,852,658 A 12/1998 Doughty et al.
5,854,542 A 12/1998 Knight et al.
5,859,508 A 1/1999 Ge et al.
5,865,529 A 1/1999 Ge et al.
5,890,794 A 2/1999 Yan
5,896,010 A 4/1999 Abtahi et al.
5,904,415 A 4/1999 Mikolajczak et al.
5,907,742 A 5/1999 Robertson et al.
5,909,378 A 5/1999 Johnson et al.
5,912,653 A 6/1999 De Milleville
5,917,287 A 6/1999 Fitch
5,917,534 A 6/1999 Haederle et al.
5,921,660 A 6/1999 Rajeswaran
5,924,784 A 7/1999 Yu
5,927,845 A 7/1999 Chliwnyj et al.
5,934,792 A 7/1999 Gustafson et al.
5,936,599 A 8/1999 Camarota
5,943,802 A 8/1999 Reymond
5,946,209 A 8/1999 Tijanic
5,949,347 A 8/1999 Eckel et al.
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,971,597 A 10/1999 Baldwin et al.
5,973,594 A 10/1999 Baldwin et al.
5,974,553 A 10/1999 Gandar
5,980,064 A 11/1999 Metroyanis
5,998,925 A 12/1999 Shimizu et al.
5,998,928 A 12/1999 Hipp

(56) References Cited

U.S. PATENT DOCUMENTS 6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
6,056,420 A 5/2000 Wilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,107,755 A 8/2000 Katyl et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,211,626 B1 4/2001 Lys et al.
6,215,409 B1 4/2001 Blach
6,217,190 B1 4/2001 Altman et al.
6,219,239 B1 4/2001 Mellberg et al.
6,220,722 B1 4/2001 Begemann
6,227,679 B1 5/2001 Zhang et al.
6,238,075 B1 5/2001 Dealey et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,290,140 B1 9/2001 Pesko et al.
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
6,388,393 B1 5/2002 Illingworth
6,388,396 B1 5/2002 Katyl et al.
6,394,623 B1 5/2002 Tsui
6,396,216 B1 5/2002 Noone et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,522,078 B1 2/2003 Okamoto et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglas, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,585,393 B1 7/2003 Brandes et al.
6,586,890 B2 7/2003 Min et al.
6,587,049 B1 7/2003 Thacker
6,590,343 B2 7/2003 Pederson
6,592,238 B2 7/2003 Cleaver et al.
6,594,369 B1 7/2003 Une
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,609,813 B1 8/2003 Showers et al.
6,612,712 B2 9/2003 Nepil
6,612,717 B2 9/2003 Yen
6,612,729 B1 9/2003 Hoffmann
6,621,222 B1 9/2003 Hong
6,623,151 B2 9/2003 Pederson
6,624,597 B2 9/2003 Dowling et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne

(56) References Cited

U.S. PATENT DOCUMENTS 6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,328 B1 5/2004 Takusagawa
6,736,525 B2 5/2004 Chin
6,741,324 B1 5/2004 Kim
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke et al.
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
7,008,079 B2 3/2006 Smith
7,014,336 B1 3/2006 Duchame et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,029,145 B2 4/2006 Frederick
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,123,139 B2 10/2006 Sweeney
7,128,442 B2 10/2006 Lee et al.
7,128,454 B2 10/2006 Kim et al.
7,132,635 B2 11/2006 Dowling
7,132,785 B2 11/2006 Duchame
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,164,863 B2 1/2007 Thomas et al.
7,165,866 B2 1/2007 Li
7,167,777 B2 1/2007 Budike, Jr.
7,168,843 B2 1/2007 Striebel
7,178,941 B2 2/2007 Roberge et al.
7,180,252 B2 2/2007 Lys et al.
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich et al.
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.

(56) References Cited

U.S. PATENT DOCUMENTS

| | | | |
|---|---|---|---|
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Marineau et al. |
| 7,237,925 | B2 | 7/2007 | Mayer et al. |
| 7,239,523 | B1 | 7/2007 | Hsu et al. |
| 7,241,038 | B2 | 7/2007 | Naniwa et al. |
| 7,242,152 | B2 | 7/2007 | Dowling et al. |
| 7,244,058 | B2 | 7/2007 | DiPenti et al. |
| 7,246,926 | B2 | 7/2007 | Harwood |
| 7,246,931 | B2 | 7/2007 | Hseih et al. |
| 7,248,239 | B2 | 7/2007 | Dowling et al. |
| 7,249,269 | B1 | 7/2007 | Motoyama |
| 7,249,865 | B2 | 7/2007 | Robertson |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| 7,449,847 | B2 | 11/2008 | Schanberger et al. |
| 7,466,082 | B1 | 12/2008 | Snyder et al. |
| 7,470,046 | B2 | 12/2008 | Kao et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| 7,490,957 | B2 | 2/2009 | Leong et al. |
| 7,494,246 | B2 | 2/2009 | Harbers et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,511,613 | B2 | 3/2009 | Wang |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| 7,530,701 | B2 | 5/2009 | Chan-Wing |
| 7,534,002 | B2 | 5/2009 | Yamaguchi et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,592,757 | B2 | 9/2009 | Hargenrader et al. |
| 7,594,738 | B1 | 9/2009 | Lin et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,616,849 | B1 | 11/2009 | Simon |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| 7,654,703 | B2 | 2/2010 | Kan et al. |
| 7,661,839 | B2 | 2/2010 | Tsai |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| 7,855,641 | B1 | 12/2010 | Okafo |
| 7,878,683 | B2 | 2/2011 | Logan et al. |
| 7,887,216 | B2 | 2/2011 | Patrick |
| 7,887,226 | B2 | 2/2011 | Huang et al. |
| 7,889,051 | B1 * | 2/2011 | Billig ..... H04L 12/2818 340/286.01 |
| 7,904,209 | B2 | 3/2011 | Podgomy et al. |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,976,185 | B2 | 7/2011 | Uang et al. |

(56) References Cited

U.S. PATENT DOCUMENTS

| | | | |
|---|---|---|---|
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| 8,093,823 | B1 | 1/2012 | Ivey et al. |
| 8,118,447 | B2 | 2/2012 | Simon et al. |
| 8,136,738 | B1 | 3/2012 | Kopp |
| 8,159,152 | B1 | 4/2012 | Salessi |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| 8,203,445 | B2 | 6/2012 | Recker et al. |
| 8,214,084 | B2 | 7/2012 | Ivey et al. |
| 8,230,690 | B1 | 7/2012 | Salessi |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,366,291 | B2 | 2/2013 | Hoffmann |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,398,275 | B2 | 3/2013 | Wang et al. |
| 8,403,692 | B2 | 3/2013 | Cao et al. |
| 8,405,314 | B2 | 3/2013 | Jensen |
| 8,434,914 | B2 | 5/2013 | Li et al. |
| 8,454,193 | B2 | 6/2013 | Simon et al. |
| 8,496,351 | B2 | 7/2013 | Lo et al. |
| 8,523,394 | B2 | 9/2013 | Simon et al. |
| 8,531,109 | B2 | 9/2013 | Visser et al. |
| 8,571,716 | B2 | 10/2013 | Ivey et al. |
| 8,628,216 | B2 | 1/2014 | Ivey et al. |
| 8,653,984 | B2 | 2/2014 | Ivey et al. |
| 8,870,412 | B1 | 10/2014 | Timmermans et al. |
| 9,016,895 | B2 | 4/2015 | Handsaker |
| 9,253,040 | B2 | 2/2016 | Pitchers |
| 2001/0015297 | A1 | 8/2001 | Harle et al. |
| 2001/0033488 | A1 | 10/2001 | Chliwnyj et al. |
| 2001/0045803 | A1 | 11/2001 | Cencur |
| 2002/0011801 | A1 | 1/2002 | Chang |
| 2002/0015297 | A1 | 2/2002 | Hayashi et al. |
| 2002/0038157 | A1 | 3/2002 | Dowling et al. |
| 2002/0041159 | A1 | 4/2002 | Kaping |
| 2002/0044006 | A1 | 4/2002 | Dowling et al. |
| 2002/0044066 | A1 | 4/2002 | Dowling et al. |
| 2002/0047516 | A1 | 4/2002 | Iwasa et al. |
| 2002/0047569 | A1 | 4/2002 | Dowling et al. |
| 2002/0047624 | A1 | 4/2002 | Stam et al. |
| 2002/0047628 | A1 | 4/2002 | Morgan et al. |
| 2002/0048169 | A1 | 4/2002 | Dowling et al. |
| 2002/0057061 | A1 | 5/2002 | Mueller et al. |
| 2002/0060526 | A1 | 5/2002 | Timmermans et al. |
| 2002/0070688 | A1 | 6/2002 | Dowling et al. |
| 2002/0074559 | A1 | 6/2002 | Dowling et al. |
| 2002/0074958 | A1 | 6/2002 | Crenshaw |
| 2002/0078221 | A1 | 6/2002 | Blackwell et al. |
| 2002/0101197 | A1 | 8/2002 | Lys et al. |
| 2002/0113555 | A1 | 8/2002 | Lys et al. |
| 2002/0130627 | A1 | 9/2002 | Morgan et al. |
| 2002/0145394 | A1 | 10/2002 | Morgan et al. |
| 2002/0145869 | A1 | 10/2002 | Dowling |
| 2002/0152045 | A1 | 10/2002 | Dowling |
| 2002/0152298 | A1 | 10/2002 | Kikta et al. |
| 2002/0153851 | A1 | 10/2002 | Morgan et al. |
| 2002/0158583 | A1 | 10/2002 | Lys et al. |
| 2002/0163316 | A1 | 11/2002 | Lys et al. |
| 2002/0171365 | A1 | 11/2002 | Morgan et al. |
| 2002/0171377 | A1 | 11/2002 | Mueller et al. |
| 2002/0171387 | A1 | 11/2002 | Morgan et al. |
| 2002/0176253 | A1 | 11/2002 | Lee |
| 2002/0176259 | A1 | 11/2002 | Ducharme |
| 2002/0179816 | A1 | 12/2002 | Haines et al. |
| 2002/0195975 | A1 | 12/2002 | Schanberger et al. |
| 2003/0011538 | A1 | 1/2003 | Lys et al. |
| 2003/0021117 | A1 | 1/2003 | Chan |
| 2003/0028260 | A1 | 2/2003 | Blackwell et al. |
| 2003/0031015 | A1 | 2/2003 | Ishibashi |
| 2003/0048641 | A1 | 3/2003 | Alexanderson et al. |
| 2003/0052599 | A1 | 3/2003 | Sun |
| 2003/0057884 | A1 | 3/2003 | Dowling et al. |
| 2003/0057886 | A1 | 3/2003 | Lys et al. |
| 2003/0057887 | A1 | 3/2003 | Dowling et al. |
| 2003/0057890 | A1 | 3/2003 | Lys et al. |
| 2003/0076281 | A1 | 4/2003 | Morgan et al. |
| 2003/0085710 | A1 | 5/2003 | Bourgault et al. |
| 2003/0095404 | A1 | 5/2003 | Becks et al. |
| 2003/0100837 | A1 | 5/2003 | Lys et al. |
| 2003/0102810 | A1 | 6/2003 | Cross et al. |
| 2003/0133292 | A1 | 7/2003 | Mueller et al. |
| 2003/0137258 | A1 | 7/2003 | Piepgras et al. |
| 2003/0185005 | A1 | 10/2003 | Sommers et al. |
| 2003/0185014 | A1 | 10/2003 | Gloisten et al. |
| 2003/0189412 | A1 | 10/2003 | Cunningham |
| 2003/0218879 | A1 | 11/2003 | Tieszen |
| 2003/0222578 | A1 | 12/2003 | Cok |
| 2003/0222587 | A1 | 12/2003 | Dowling et al. |
| 2003/0234342 | A1 | 12/2003 | Gaines et al. |
| 2004/0003545 | A1 | 1/2004 | Gillespie et al. |
| 2004/0007980 | A1 | 1/2004 | Shibata |
| 2004/0012959 | A1 | 1/2004 | Robertson et al. |
| 2004/0036006 | A1 | 2/2004 | Dowling |
| 2004/0037088 | A1 | 2/2004 | English et al. |
| 2004/0052076 | A1 | 3/2004 | Mueller et al. |
| 2004/0062041 | A1 | 4/2004 | Cross et al. |
| 2004/0075572 | A1 | 4/2004 | Buschmann et al. |
| 2004/0080960 | A1 | 4/2004 | Wu |
| 2004/0090191 | A1 | 5/2004 | Mueller et al. |
| 2004/0090787 | A1 | 5/2004 | Dowling et al. |
| 2004/0105261 | A1 | 6/2004 | Ducharme et al. |
| 2004/0105264 | A1 | 6/2004 | Spero |
| 2004/0113568 | A1 | 6/2004 | Dowling et al. |
| 2004/0114371 | A1 | 6/2004 | Lea et al. |
| 2004/0116039 | A1 | 6/2004 | Mueller et al. |
| 2004/0124782 | A1 | 7/2004 | Yu |
| 2004/0130908 | A1 | 7/2004 | McClurg et al. |
| 2004/0130909 | A1 | 7/2004 | Mueller et al. |
| 2004/0141321 | A1 | 7/2004 | Dowling et al. |
| 2004/0145886 | A1 | 7/2004 | Fatemi et al. |
| 2004/0155609 | A1 | 8/2004 | Lys et al. |
| 2004/0160199 | A1 | 8/2004 | Morgan et al. |
| 2004/0178751 | A1 | 9/2004 | Mueller et al. |
| 2004/0189262 | A1 | 9/2004 | McGrath |
| 2004/0212320 | A1 | 10/2004 | Dowling et al. |
| 2004/0212321 | A1 | 10/2004 | Lys et al. |
| 2004/0212993 | A1 | 10/2004 | Morgan et al. |
| 2004/0223328 | A1 | 11/2004 | Lee et al. |
| 2004/0240890 | A1 | 12/2004 | Lys et al. |
| 2004/0251854 | A1 | 12/2004 | Matsuda et al. |
| 2004/0257007 | A1 | 12/2004 | Lys et al. |
| 2005/0013133 | A1 | 1/2005 | Yeh |
| 2005/0023536 | A1 | 2/2005 | Shackle |
| 2005/0024877 | A1 | 2/2005 | Frederick |
| 2005/0030744 | A1 | 2/2005 | Ducharme et al. |
| 2005/0035728 | A1 | 2/2005 | Schanberger et al. |
| 2005/0036300 | A1 | 2/2005 | Dowling et al. |
| 2005/0040774 | A1 | 2/2005 | Mueller et al. |
| 2005/0041161 | A1 | 2/2005 | Dowling et al. |
| 2005/0041424 | A1 | 2/2005 | Ducharme |
| 2005/0043907 | A1 | 2/2005 | Eckel et al. |
| 2005/0044617 | A1 | 3/2005 | Mueller et al. |

(56) References Cited

U.S. PATENT DOCUMENTS

| | | | | |
|---|---|---|---|---|
| 2005/0047132 | A1 | 3/2005 | Dowling et al. | |
| 2005/0047134 | A1 | 3/2005 | Mueller et al. | |
| 2005/0062440 | A1 | 3/2005 | Lys et al. | |
| 2005/0063194 | A1 | 3/2005 | Lys et al. | |
| 2005/0078477 | A1 | 4/2005 | Lo | |
| 2005/0093488 | A1 | 5/2005 | Hung et al. | |
| 2005/0099824 | A1 | 5/2005 | Dowling et al. | |
| 2005/0107694 | A1 | 5/2005 | Jansen et al. | |
| 2005/0110384 | A1 | 5/2005 | Peterson | |
| 2005/0116667 | A1 | 6/2005 | Mueller et al. | |
| 2005/0128751 | A1 | 6/2005 | Roberge et al. | |
| 2005/0141225 | A1 | 6/2005 | Striebel | |
| 2005/0151489 | A1 | 7/2005 | Lys et al. | |
| 2005/0151663 | A1 | 7/2005 | Tanguay | |
| 2006/0192502 | A1 | 8/2006 | Brown et al. | |
| 2008/0157957 | A1* | 7/2008 | Pitchers ..... | H05B 37/02<br>340/539.1 |

* cited by examiner

SYSTEM AND METHOD FOR CONTROLLING OPERATION OF AN LED-BASED LIGHT

CROSS REFERENCE TO RELATED APPLICATIONS

This application is a continuation of U.S. Utility application Ser. No. 15/008,864, filed Jan. 28, 2016, which is a continuation of U.S. Utility application Ser. No. 13/934,607, filed Jul. 3, 2013, which claims priority benefit to U.S. Provisional Patent Application No. 61/669,319 filed Jul. 9, 2012, the contents of which are hereby incorporated by reference in their entirety.

TECHNICAL FIELD

The embodiments disclosed herein relate in general to a light emitting diode (LED)-based light for replacing a conventional light in a standard light fixture, and in particular to a lighting control system for controlling the operation of an LED-based light.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years. LED-based lights can be used in a building with a control system capable of managing various aspects of the building, including its lighting conditions. A lighting control system can be designed to regulate the lighting conditions in a building through selective control of the operation of LED-based lights, in order to, for example, improve usability of the building or to optimize its energy use. Some of these lighting control systems can remotely regulate individual lighting conditions of multiple different areas within the building. Such individualized regulation requires some form of association between each LED-based light and the particular area in which the LED-based light is positioned to illuminate. Association can entail, for example, manually assigning an LED-based light positioned to illuminate a particular area with a logical address designated within the lighting control system to correspond to that area. Once associated, the lighting control system can correctly control operation of an LED-based light based upon the desired lighting conditions for its respective area.

SUMMARY

Disclosed herein are embodiments of methods and systems for controlling operation of a light source. In one aspect, a method of associating a light source with an area for which the light source is positioned to provide lighting comprises: identifying, based on a determined physical position of a light source, one of a plurality of areas as the area for which the light source is positioned to provide lighting; identifying at least one desired lighting condition for the identified area; and controlling, using a processor, operation of the light source based on the identified at least one desired lighting condition for the identified area.

In another aspect, alighting control system comprises: a light source positioned to provide lighting for an area; and a control unit configured to: identify, based on a determined physical position of the light source, one of a plurality of areas as the area for which the light source is positioned to provide lighting, identify at least one desired lighting condition for the identified area, and control operation of the light source based on the identified at least one desired lighting condition for the identified area.

In yet another aspect, a method of selecting a lighting condition for controlling operation of a light source comprises: storing, in memory, a plurality of position-dependent lighting conditions; and selecting, using a processor in communication with the memory, one of the position-dependent lighting conditions for controlling operation of the light source based on a determined physical position of the light source, such that the operation of the light source is controlled based on the selected position-dependent lighting condition.

These and other aspects will be described in additional detail below.

BRIEF DESCRIPTION OF THE DRAWINGS

The various features, advantages and other uses of the present system and methods will become more apparent by referring to the following detailed description and drawings in which.

DETAILED DESCRIPTION

Manual association between an LED-based light and the particular area in which the LED-based light is positioned to illuminate can be time consuming and error-prone. Further, associations can be broken if a logically addressable LED-based light is moved and/or replaced during service, which can cause incorrect control over the operation of the LED-based light.

Disclosed herein are example configurations of a lighting control system for a building that can use information relating to the position of an LED-based light to associate the LED-based light with a particular area for purposes of regulating the lighting conditions for that area. Further disclosed herein are exemplary configurations of a control system that can reduce the amount of user input required to determine the information relating to the position of the LED-based light.

A building can include systems for managing various aspects of the building. These aspects can generally include the environmental conditions of the building, such as heating, ventilation and air conditioning (HVAC) conditions, security conditions and/or lighting conditions, for example. A "smart" building can include a control system, such as a building automation system, that can automatically manage the environmental conditions of the building in accordance with desired environmental conditions. Such buildings can include one or more areas located throughout the building, with each area lending itself to individualized regulation of one or more of its environmental conditions.

Figure 1:
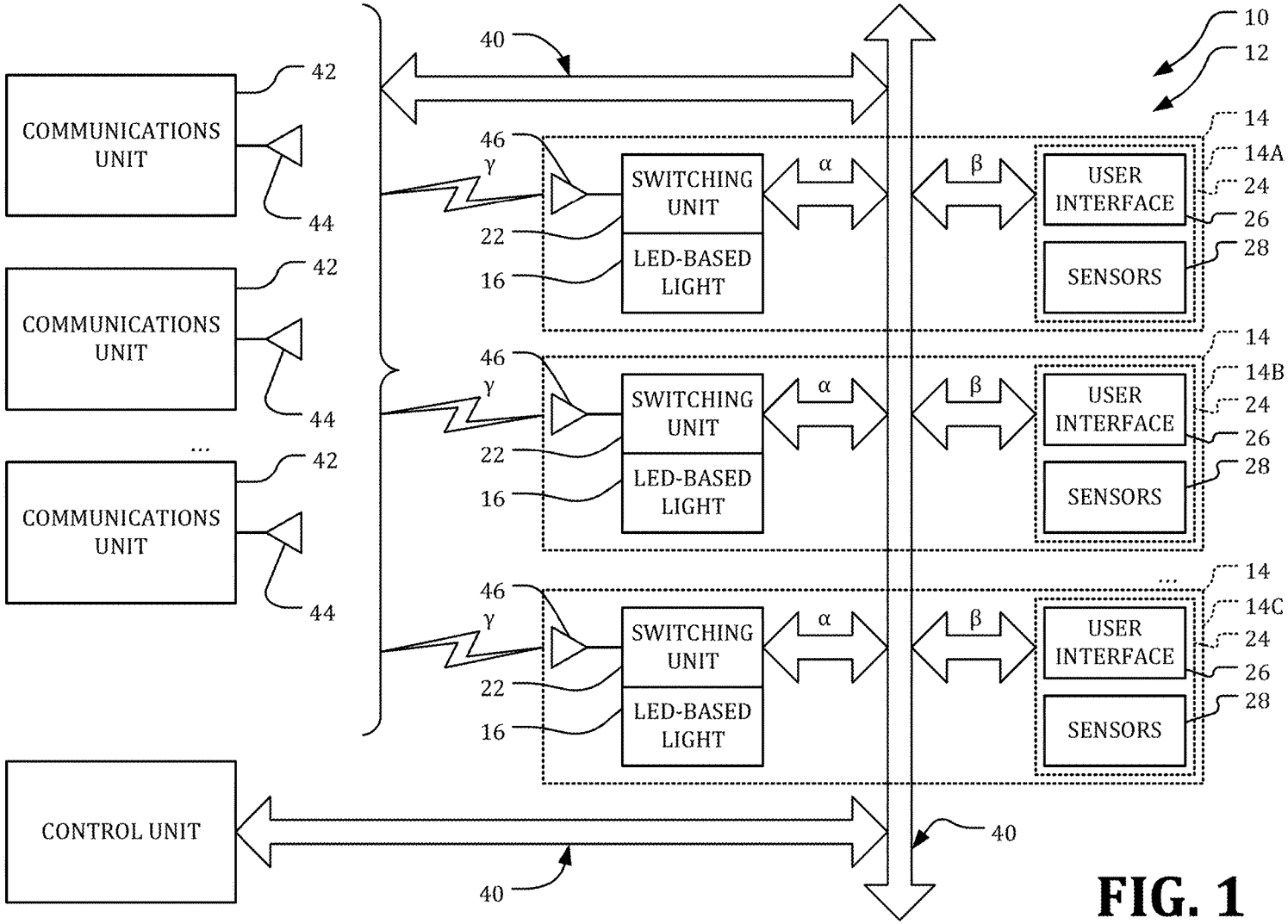
FIG. 1 is a system view of a lighting control system configured to control operation of an LED-based light.

A representative building 10 including a building automation system implementing a lighting control system 12 for regulating the lighting conditions of multiple areas 14 throughout the building 10 is shown in FIG. 1. The terms "building" and "building automation system" are used herein to describe the lighting control system 12 with reference to a representative setting in which the lighting control system 12 can be implemented. However, the lighting control system 12 could be implemented in other settings, such as outdoors, for example, or in other settings in which a number of different areas 14 lending themselves to individualized regulation with respect to their lighting conditions can be defined.

Regulation of the environmental conditions of the multiple areas 14 located throughout the building 10 can include a process of defining the areas 14 to be controlled. Each area 14, as it relates to individualized regulation of its environmental conditions, can correspond to some characteristic of the building 10 or its contents, or can correspond to some characteristic of the defined area 14. With respect to regulation of lighting conditions with the lighting control system 12, for example, the area 14 could be defined as an individual room or group of rooms located within the building 10. The area 14 could additionally or alternatively be defined in terms of its physical surroundings, such as an area adjacent to source of light extrinsic to the lighting control system 12, for instance a window supplying natural light. The area 14 could also be defined in relation to its particular functional considerations and/or constraints with respect to lighting conditions. For example, the area 14 could be defined above a workstation, or the area 14 could correspond to a particular type of room within the building 10, such as an office, a conference room, a hallway or a bathroom, for example. Similarly, the area 14 could be defined in relation to its particular requirements with respect to lighting conditions, which could involve requirements of performance lighting, efficient lighting, safety lighting, comfort lighting and/or alarm lighting, for example. As a non-limiting example, an area 14A could be an individual room located within the building 10, an area 14B could be located adjacent an east facing window receiving natural light and thereby requiring less artificial light from the lighting control system 12, and an area 14C could be located adjacent a desk or other workstation.

An area 14 could be one discrete individual location within the building 10, or could comprise some grouping of locations lending themselves to similar regulation of their environmental conditions. A building 10 could include a single area 14 or multiple areas 14, and each area 14 of a building 10 need not be defined according to an approach used to define another area 14 of the building 10. The building 10 can include more or less than the illustrated areas 14A, 14B and 14C, and the building 10 can include alternative and/or additional areas 14 depending upon which of a variety of environmental conditions is regulated. That is, with respect to regulation of environmental conditions other than lighting conditions, areas 14 could be defined within the building 10 other than as the areas 14A, 14B and 14C described above, and alternative and/or additional areas 14 could be defined for purposes of individualized regulation of the various other environmental conditions.

A building automation system for the building 10 can implement the lighting control system 12 to individually regulate the lighting conditions for each of the areas 14 located throughout the building 10. The illustrated lighting control system 12 may include one or more LED-based lights 16 positioned to illuminate each of the areas. The lighting conditions for the area 14 in which an LED-based light 16 is positioned can be regulated through selective control of the operation the LED-based light 16. For ease of understanding, the lighting control system 12 is generally described below with reference to a single LED-based light 16 positioned to illuminate a singular area 14. However, it should be understood that the lighting control system 12 can include a plurality of areas 14A, 14B and 14C, each of which can include one or more respective LED-based lights 16 positioned to illuminate the areas 14A, 14B and 14C.

The lighting control system 12 includes one or more devices for controlling the operation of the LED-based light 16. In a basic lighting system, operation of an LED-based light 16 could be controlled by electrically connecting a device such as a light switch, dimmer or other similar operator actuated device between the LED-based light 16 and a power supply. These devices control operation of the LED-based light 16 by regulating a supply of AC or DC electrical power to the LED-based light 16. For example, a supply of electrical power to the LED-based light 16 can be selectively switched to control an on/off function of the LED-based light 16, and a supply of electrical power to the LED-based light 16 can be selectively modulated to control a dimming function of the LED-based light 16.

The illustrated implementation of the lighting control system 12 includes a control unit 20 configured to control the operation of the LED-based light 16 by selectively controlling a supply of electrical power to the LED-based light 16. The control unit 20 can be or include one or more controllers configured for controlling the operation of multiple LED-based lights 16 positioned in different areas 14 located throughout the building 10. A controller could be a programmable controller, such as a microcomputer including a random access memory (RAM), a read-only memory (ROM) and a central processing unit (CPU) in addition to various input and output connections. Generally, the control functions described herein can be implemented by one or more software programs stored in internal or external memory and are performed by execution by the CPU. However, some or all of the functions could also be implemented by hardware components. Although the control unit 20 is shown and described as a single central controller for performing multiple functions related to multiple areas 14, the functions described herein could be implemented by separate controllers which collectively comprise the illustrated control unit 20.

The control unit 20 can be electrically connected between the LED-based light 16 and a power supply and configured to control operation of the LED-based light 16 by directly switching and/or modulating a supply of electrical power to LED-based light 16. Alternatively, the control unit 20 can be configured to control operation of the LED-based light 16 by indirectly controlling a supply of electrical power to the LED-based light 16, for example by communicating a control signal $\alpha$ to a switching device. For example, as shown in FIG. 1, lighting control system 12 may include a switching unit 22 communicatively coupled to the control unit 20.

The switching unit 22 is electrically connected between the LED-based light 16 and a power supply and is configured to receive the control signal $\alpha$ and, in response to the control signal $\alpha$, selectively regulate a supply of electrical power to the LED-based light 16. The switching unit 22 can control an on/off function of the LED-based light 16 by including a relay or other mechanical, electrical or electromechanical switch configured to selectively switch a supply of electrical power to the LED-based light 16. The switching unit 22 can alternatively or additionally be or include components configured to selectively modulate a supply of electrical power to the LED-based light 16 to control a dimming function of the LED-based light 16. The switching unit 22 can selectively regulate a supply of electrical power to the LED-based light 16 to control operation of the LED-based light 16 in a variety of other manners. For example, in addition to controlling on/off and dimming functions of the LED-based light 16, the switching unit 22 can also be configured to regulate a supply of electrical power to the LED-based light 16 to achieve continuous, intermittent or other non-continuous operation of the LED-based light 16. For example, the LED-based light 16 could be operated steadily, variably, or could be blinked, flashed or amplified according to some timed pattern by the switching unit 22, depending upon the desired lighting conditions for the area 14 in which the LED-based light 16 is positioned to illuminate.

Each area 14 located throughout the building 10 can lend itself to individualized regulation of its lighting conditions in accordance with respective desired lighting conditions. The lighting control system 12 includes the control unit 20 for controlling the lighting conditions of the area 14 through selective control of the operation of the LED-based light 16 positioned to illuminate the area 14. As described above, the control unit 20 controls the operation of the LED-based light 16 by communicating a control signal α to the switching unit 22 configured to selectively regulate a supply of electrical power to the LED-based light 16. The control signal α generally corresponds to the desired lighting conditions for the area 14 in which the LED-based light 16 is positioned to illuminate. The control signal α can be representative of a setpoint illumination level for the area 14, or could be representative of some other particular requirement or characteristic with respect to the desired lighting conditions for the area 14 in which the LED-based light 16 is positioned to illuminate. For example, the control signal α could be representative of a requirement for performance lighting, efficient lighting, safety lighting, comfort lighting and/or alarm lighting in the area 14.

The control unit 20 is configured to determine the desired lighting conditions for the area 14 in which the LED-based light 16 is positioned to illuminate, and to generate the control signal α corresponding to the desired lighting conditions. The control unit 20 can generate the control signal α with logic implementing various algorithmic or heuristics techniques. As non-limiting examples, the control unit 20 can include logic implementing timers, alarms, and/or rules relating to occupancy sensing, daylight harvesting or manual override control.

The lighting control system 12 can further include one or more input devices 24 corresponding to each of the areas 14. The input devices 24 are configured to relay information relating to the actual or desired lighting conditions and/or other environmental conditions of the area 14 to the control unit 20. The lighting control system 12 can utilize the information from an input device 24 for purposes of individualized regulation of the lighting conditions for its area 14. The input devices 24 are configured to generate one or more input signals β. The input devices 24 are communicatively coupled to the control unit 20, and the logic of the control unit 20 can be responsive to the input signals β to generate the control signal α for communication to the switching unit 22.

The illustrated input devices 24 can include a user interface 26 and various sensors 28. The user interface 26 is configured to receive information from a user of the building 10 relating to requested lighting conditions for the area 14 to which the user interface 26 corresponds, and to generate corresponding input signals β for communication to the control unit 20. The user interface 26 can be or include a switch, dimmer or other user actuated device. The user interface 26 could also include a web-based or similar computer-based component for receiving information relating to requested lighting conditions for an area 14.

The lighting control system 12 can incorporate the input signals β communicated from the user interface 26 to varying degrees as compared to input signals β communicated from other input devices 24. For example, the lighting control system 12 could give priority to the user interface 26 by providing for manual override control of the operation of the LED-based light 16 on the basis of a user's actuation of the user interface 26. In this example, the control unit 20 could include logic for generating a control signal α directing the switching unit 22 to regulate a supply of electrical power to the LED-based light 16 in direct accordance with an operator's requested lighting conditions. Alternatively, the lighting control system 12 could be arranged such that a supply of electrical power to LED-based light 16 is regulated directly by the user interface 26 in accordance with an operator's requested lighting conditions without regard to a control signal α generated by the control unit 20.

The sensors 28 may be configured for measuring, monitoring and/or estimating various environmental conditions within a corresponding area 14 and for generating corresponding input signals β for communication to the control unit 20. Sensors 28 can include, for example, a sensor for measuring the actual lighting conditions of the area 14, or sensors 28 could include a sensor for monitoring or estimating occupancy of the area 14. The sensors 28 could include a motion sensor, a voice-activated sensor or a clock or calendar, for example. Similar to the input signals β from the user interface 26, the input signals β from the sensors 28 can be incorporated into the logic of the control unit 20 for generation of the control signal α.

An exemplary communications link 40 is included in the lighting control system 12 for communicatively coupling the components of the lighting control system 12. The communications link 40 may generally be configured to support digital and/or analog communication between the components included in the lighting control system 12. For example, the communications link 40 may be configured to communicatively couple the control unit 20, the switching unit 22 and the input devices 24. The communications link 40 can include wired and/or wireless communications channels using any industry standard or proprietary protocols. As a non-limiting example, a wired communications link 40 could be implemented with 0-10V signals, DALI or Ethernet. As a further non-limiting example, a wireless communications link 40 could be implemented, for example, with wireless DALI, IEEE 802.11, Wi-Fi, Bluetooth or RF channels, or through infrared, ultrasonic or modulated visible light, such as light emitted from the LED-based lights 16. Further, the communications link 40 could be implemented with multiple communications channels, each using differing protocols.

The illustrated lighting control system 12 can provide localized regulation of the lighting conditions for multiple different areas 14 with the control unit 20 by selectively controlling the operation of the respective LED-based lights 16 positioned to illuminate the respective areas 14. The control unit 20 can determine differing desired lighting conditions for each of the areas 14. For example, the desired lighting conditions for area 14A could necessitate that the LED-based light 16 positioned to illuminate area 14A be controlled to an on state, the desired lighting conditions for area 14B could necessitate that the LED-based light 16 positioned to illuminate area 14B be controlled to an off state, and the desired lighting conditions for area 14C could necessitate that the LED-based light 16 positioned to illuminate area 14C be controlled to a modulated state.

In order for the lighting control system 12 to efficiently regulate the lighting conditions in multiple areas 14, the lighting control system 12 may be configured to control the LED-based light 16 positioned to illuminate a particular area 14 without affecting the operation of LED-based lights 16 positioned to illuminate other areas 14. Proper functioning of the lighting control system 12 generally requires some association between each LED-based light 16 and the area 14 in which the LED-based light 16 is positioned to illuminate. Association can entail, for example, manually landing wires between terminals of the control unit 20 and switching units 22 and/or corresponding LED-based lights 16. Alternatively, association could entail manually assigning a switching unit 22 and/or corresponding LED-based light 16 with a logical address designated within the lighting control system 12, for example within the logic of the control unit 20, to correspond to a particular area 14. Once associated, the lighting control system 12 can control operation of an LED-based light 16 to regulate the lighting conditions for its respective area 14 according to its desired lighting conditions.

The illustrated lighting control system 12 may include a plurality of communications units 42 configured to receive information relating to the position of an LED-based light 16 within the building 10. The lighting control system 12 is configured to use the information relating to the position of the LED-based light 16 within the building 10 to associate the LED-based light 16 with the area 14 in which the LED-based light 16 is positioned to illuminate. For example, the lighting control system 12 can be configured to compare the position of an LED-based light 16 with known or determined positions of the areas 14 located throughout the building 10. The lighting control system 12 can then correlate the position of the LED-based light 16 with a particular area 14 in which the LED-based light 16 is positioned to illuminate. Once a correlation is drawn between a particular LED-based light 16 and the area 14 in which the LED-based light 16 is positioned to illuminate, the lighting control system 12 can associate the LED-based light 16 to the area 14 for purposes of future regulation of the lighting conditions for that area 14.

The communications units 42 may be communicatively coupled to the lighting control system 12 through one or more communications channels that can be included in the communications link 40. As shown in FIG. 1, the communications units 42 may be communicatively coupled to the switching units 22. Each of the communications units 42 may include a communications device 44 configured to receive a location signal γ from a communications device 46 included in the switching units 22. The communications devices 44 and 46 can be configured for communication through a communications channel implemented to communicatively couple the communications units 42 and the switching units 22, and the communications channel need not be the same as used elsewhere in the communication link 40. For example, an existing building automation system for the building 10 may already include wired communications channels for communicatively coupling the control unit 20, the switching unit 22 and the input devices 24. The building automation system for the building 10 could be retrofitted to implement the lighting control system 12 by including a wireless communications channel configured to communicatively couple the communications units 42 to the switching units 22. In this non-limiting example, the communications devices 44 and 46 can be the illustrated transceivers 44 and 46. However, the communications devices 44 and 46 could be other devices known to those skilled in the art configured to send and/or receive the location signal γ over a chosen communications channel included in the communications link 40.

As shown in FIG. 1, the communications units 42 may be communicatively coupled to switching units 22 to receive the location signal γ from the communications devices 46. The switching units 22 including the communications devices 46 can be located adjacent to or included in corresponding LED-based lights 16, such that the location signal γ conveys information generally relating to the position of the LED-based light 16. Although the communications devices 46 are described with reference to the switching units 22, the communications devices 46 could alternatively be included in the LED-based lights 16, or could be otherwise included in the lighting control system 12 according to some known or determinable spatial relationship with the LED-based light 16.

The lighting control system 12 is configured to determine, or estimate, the physical position of each of the LED-based lights 16 based at least partially upon the location signal γ. The position of an LED-based light 16 could be determined absolutely, for example, or could be determined relative to some aspect relating to the building 10 or lighting control system 12. In the exemplary implementation of the lighting control system 12, multiple communications units 42 form a spatially distributed network of communications units 42. The communications units 42 can be distributed within and/or without the building 10 to form the spatially distributed network of communications units 42. The location signal γ can be received by one or more of the communications units 42, which can be configured to determine the position of the LED-based lights 16, either individually, in some combination with each other, and/or in combination with the control unit 20 or other components of the lighting control system 12.

The lighting control system 12 can be configured to determine the position of the LED-based light 16 using various techniques, either individually or in some combination. As non-limiting examples, the position of an LED-based light 16 can be determined based upon time of arrival (TOA) of RF, infrared or ultrasonic signals, or based upon TOA of light signals, such as visible light signals emitted from the LED-based lights 16; the position of an LED-based light 16 can be determined based upon direction finding (DF) of RF, infrared or ultrasonic signals, or based upon DF of light signals, such as visible light signals emitted from the LED-based lights 16; the position of an LED-based light 16 could be determined by superimposing currents on power lines forming a power grid, or though other branch circuit monitoring methods; or the position of an LED-based light 16 could be determined by monitoring the strength of the location signal γ throughout the spatially distributed network of communications units 42. The position of an LED-based light 16 could also be determined through communication with components external from the lighting control system 12, for example by using 3g or 4g signals to communicate with global positioning systems (GPSs) or other external location systems. The position of the LED-based light 16 could also be determined more accurately through some combination of the above techniques.

Figure 2:
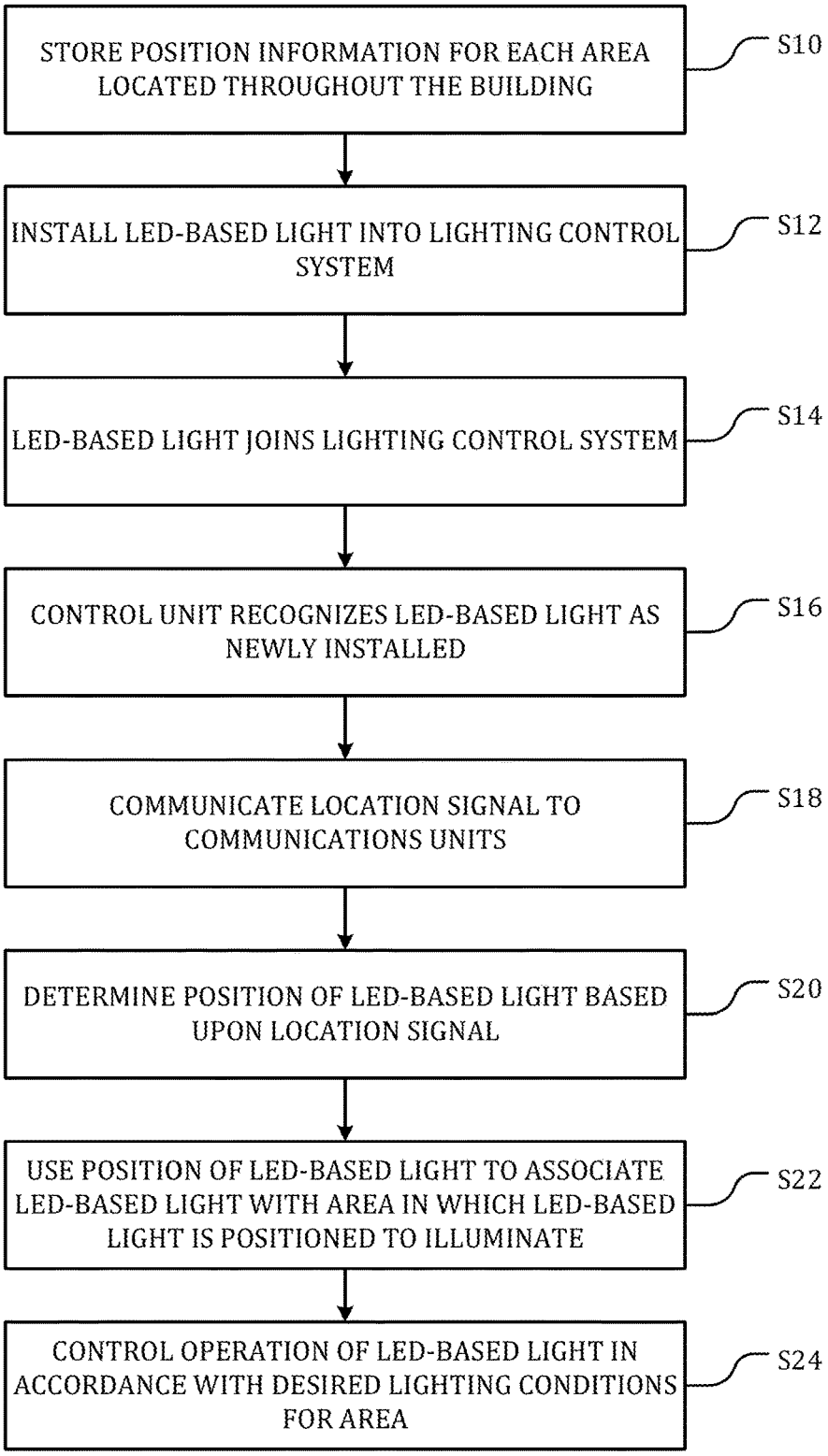
FIG. 2 is a flow chart illustrating a process including operations for installing and associating the LED-based light of FIG. 1 within the lighting control system.

A process of installing an LED-based light 16 into the lighting control system 12 of a building 10 is illustrated in FIG. 2. In step S10, information relating to the positions of each of the areas 14 located throughout the building 10 is stored in the lighting control system 12. The lighting control system 12 can be configured to know or determine the positions of each of the areas 14. Similar to the positions of the LED-based lights 16, the positions of the areas 14 could be known or determined absolutely, for example, or relative to some aspect relating to the building 10 or the lighting control system 12. For example, the physical aspects of the building 10, such as floor plans or power supply structures, could be stored in memory on the control unit 20, along with information relating to the relative positions of the areas 14 within the building 10.

In step S12, an LED-based light 16 is installed into the lighting control system 12. In step S14, the LED-based light 16 joins the lighting control system 12 by communicating with the control unit 20 through the communications link 40, and in step S16, the control unit 20 recognizes the LED-based light 16 as newly installed into (or newly positioned within) the lighting control system 12. The LED-based light 16 can have a logical address readable by the control unit 20, for example, or can be otherwise recognizable by the control unit 20 as a distinct lighting element.

In step S18, the location signal γ is communicated to the spatially distributed network of communications units 42. The location signal γ can be communicated autonomously, for example, or at the direction of the installer or at the direction of the lighting control system 12 or control unit 20. In step S20, the position of the LED-based light 16 is determined using one or more of the above described location techniques, as well as others. The logic for determining the position of the LED-based light 16 can be implemented by one or more of the communications units 42, or can be distributed between one or more of the communications units 42 and the other components of the lighting control system 12. The position of an LED-based light 16 could also be determined physically externally from the lighting control system 12, for example through communication with a GPS or other location system. The position of the newly installed LED-based 16 could also be determined and/or verified with reference to one or more LED-based lights 16 whose positions are manually determined.

In step S22, the lighting control system 12 can use the determined position of the LED-based light 16 to associate the LED-based light 16 with the area 14 in which the LED-based light 16 is positioned to illuminate. For example, the lighting control system 12 can implement logic using the control unit 20 to compare the determined position of the LED-based light 16 with the known or determined positions of the areas 14 located throughout the building 10. By correlating the determined position of the LED-based light 16 with a position of a particular area 14, the control unit 20 can determine that the LED-based light 16 is positioned to illuminate that particular area 14. Finally, in step S24, the lighting control system 12 can associate the LED-based light 16 to the area 14 within the control unit 20 for purposes of future regulation of the lighting conditions for that area 14.

Figure 3:
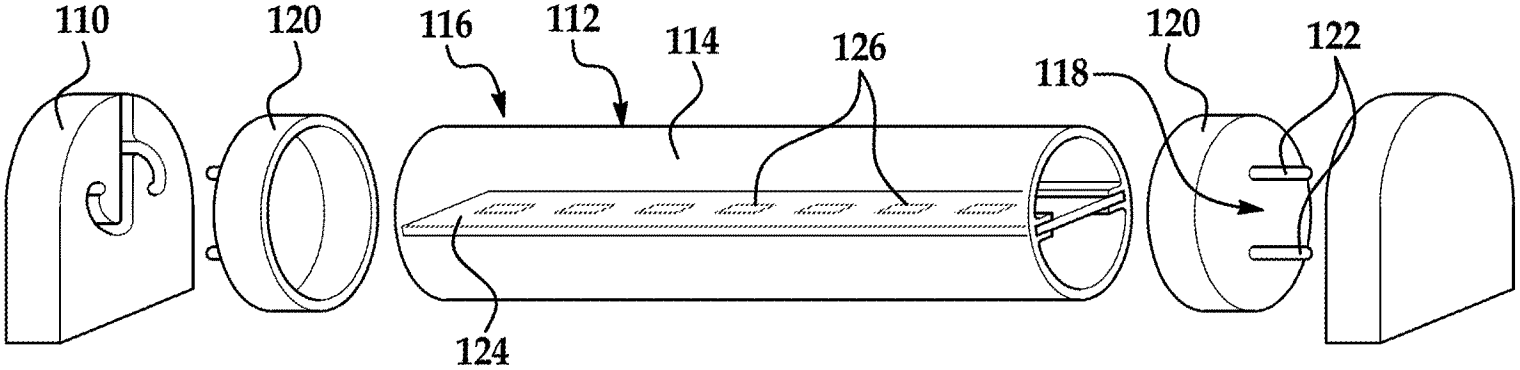
FIG. 3 is an exploded perspective view of an example of an LED-based light for use in the lighting control system of FIG. 1.

FIG. 3 illustrates an example of an LED-based light 116 for use in the lighting control system 12. The LED-based light 116 is configured to replace a conventional light in a standard light fixture 110. The light fixture 110 can be designed to accept conventional fluorescent lights, such as T5, T8 or T12 fluorescent tube lights, or can be designed to accept other standard lights, such as incandescent bulbs. The light fixture 110 could alternatively be designed to accept non-standard lights, such as lights installed by an electrician. The light fixture 110 can connect to a power supply, and can optionally include a ballast connected between the power supply and the LED-based light 116. The switching unit 22 could be compatible with the fixture 110 to electrically connect between the power supply and the LED-based light 116, or the switching unit 22 could be included in the fixture 110, for example.

In some implementations, the LED-based light 116 includes a housing 112 at least partially defined by a high dielectric light transmitting lens 114. The lens 114 can be made from polycarbonate, acrylic, glass or other light transmitting material (i.e., the lens 114 can be transparent or translucent). The term "lens" as used herein means a light transmitting structure, and not necessarily a structure for concentrating or diverging light. The LED-based light 116 can include features for uniformly distributing light to an environment to be illuminated in order to replicate the uniform light distribution of a conventional fluorescent light. For example, the lens 114 can be manufactured to include light diffracting structures, such as ridges, dots, bumps, dimples or other uneven surfaces formed on an interior or exterior of the lens 114. The light diffracting structures can be formed integrally with the lens 114, for example, by molding or extruding, or the structures can be formed in a separate manufacturing step such as surface roughening. In addition to or as an alternative to light diffracting structures, a light diffracting film can be applied to the exterior of the lens 114 or placed in the housing 112, or, the material from which the lens 114 is formed can include light refracting particles. For example, the lens 114 can be made from a composite, such as polycarbonate, with particles of a light refracting material interspersed in the polycarbonate. In other embodiments, the LED-based light 116 may not include any light diffracting structures or film.

The housing 112 can include a light transmitting tube at least partially defined by the lens 114. Alternatively, the housing 112 can be formed by attaching multiple individual parts, not all of which need be light transmitting. For example, the housing 112 can be formed in part by attaching the lens 114 to an opaque lower portion. The housing 112 can additionally include other components, such as one or more highly thermally conductive structures for enhancing heat dissipation. While the illustrated housing 112 is cylindrical, a housing having a square, triangular, polygonal, or other cross sectional shape can alternatively be used. Similarly, while the illustrated housing 112 is linear, housings having an alternative shape, e.g., a U-shape or a circular shape can alternatively be used. The LED-based light 116 can have any suitable length. For example, the LED-based light 116 may be approximately 48" long, and the housing 112 can have a 0.625", 1.0" or 1.5" diameter for engagement with a common standard fluorescent light fixture.

The LED-based light 116 can include an electrical connector 118 positioned at each end of the housing 112. In the illustrated example, the electrical connector 118 is a bi-pin connector carried by an end cap 120. A pair of end caps 120 can be attached at opposing longitudinal ends of the housing 112 for physically connecting the LED-based light 116 to a standard fluorescent light fixture 110. The end caps 120 can be the sole physical connection between the LED-based light 116 and the fixture 110. At least one of the end caps 120 can additionally electrically connect the LED-based light 116 to the fixture 110 to provide power to the LED-based light 116. Each end cap 120 can include two pins 122, although two of the total four pins can be "dummy pins" that provide physical but not electrical connection to the fixture 110. Bi-pin electrical connector 118 is compatible with many standard fluorescent fixtures, although other types of electrical connectors can be used, such as single pin connector or screw type connector.

The LED-based light 116 can include a circuit board 124 supported within the housing 112. The circuit board 124 can include at least one LED 126, a plurality of series-connected or parallel-connected LEDs 126, an array of LEDs 126 or any other arrangement of LEDs 126. Each of the illustrated LEDs 126 can include a single diode or multiple diodes, such as a package of diodes producing light that appears to an ordinary observer as coming from a single source. The LEDs 126 can be surface-mount devices of a type available from Nichia, although other types of LEDs can alternatively be used. For example, the LED-based light 116 can include high-brightness semiconductor LEDs, organic light emitting diodes (OLEDs), semiconductor dies that produce light in response to current, light emitting polymers, electro-luminescent strips (EL) or the like.

The circuit board 124 can include power supply circuitry configured to condition an input power received from, for example, the fixture 110 through the electrical connector 118 to a power usable by and suitable for the LEDs 126. In some implementations, the power supply circuitry can include one or more of an inrush protection circuit, a surge suppressor circuit, a noise filter circuit, a rectifier circuit, a main filter circuit, a current regulator circuit and a shunt voltage regulator circuit. The power supply circuitry can be suitably designed to receive a wide range of currents and/or voltages from a power source and convert them to a power usable by the LEDs 126.

The circuit board 124 is illustrated as an elongate printed circuit board. The circuit board 124 can extend a length or a partial length of the housing 112. Multiple circuit board sections can be joined by bridge connectors to create the circuit board 124. The circuit board 124 can be supported within the housing 112 through slidable engagement with a part of the housing 112, though the circuit board 124 can alternatively be clipped, adhered, snap- or friction-fit, screwed or otherwise connected to the housing 112. Also, other types of circuit boards may be used, such as a metal core circuit board. Or, instead of the circuit board 124, other types of electrical connections (e.g., wires) can be used to electrically connect the LEDs 126 to a power source.

The LEDs 126 can emit white light or light within a range of wavelengths. However, LEDs that emit blue light, ultraviolet light or other wavelengths of light can be used in place of or in combination with white light emitting LEDs 126. The number, spacing and orientation of the LEDs 126 can be a function of a length of the LED-based light 116, a desired lumen output of the LED-based light 116, the wattage of the LEDs 126 and/or the viewing angle of the LEDs 126. For a 48" LED-based light 116, the number of LEDs 126 may vary from about thirty to sixty such that the LED-based light 116 outputs approximately 3,000 lumens. However, a different number of LEDs 126 can alternatively be used, and the LED-based light 116 can output any other amount of lumens. The LEDs 126 can be evenly spaced along the circuit board 124 and arranged on the circuit board 124 to substantially fill a space along a length of the lens 114 between end caps 120 positioned at opposing longitudinal ends of the housing 112. Alternatively, single or multiple LEDs 126 can be located at one or both ends of the LED-based light 116. The LEDs 126 can be arranged in a single longitudinally extending row along a central portion of the LED circuit board 124, as shown, or can be arranged in a plurality of rows or arranged in groups. The spacing of the LEDs 126 can be determined based on, for example, the light distribution of each LED 126 and the number of LEDs 126.

Figure 4:
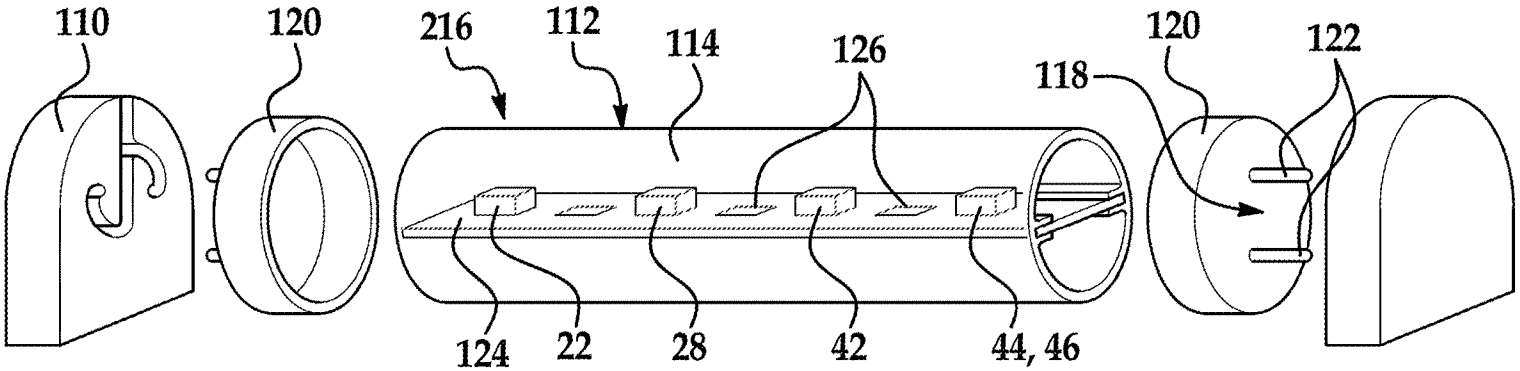
FIG. 4 is an exploded perspective view of an alternative example of an LED-based light for use in the lighting control system of FIG. 1.

An alternative example of and LED-based light 216 is shown in FIG. 4. The construction of the LED-based light 216 can be similar to the construction of the LED-based light 116 of FIG. 3, and the LED-based light 216 can include the housing 112, the lens 114, the bi-pin 122 electrical connectors 118 carried by a pair of end caps 120, the circuit board 124 and the LEDs 126.

In addition, the LED-based light 216 can incorporate one or more of the above described components of the lighting control system 12. For example, the switching unit 22 can be included the LED-based light 216. The switching unit 22 can be included in the circuit board 124 and can be electrically connected between the fixture 110 conveying electrical power from a power supply and the LEDs 126 of the LED-based light 216. The switching unit 22 of the LED-based light 216 can be configured to receive the control signal $\alpha$ and, in response to the control signal $\alpha$, selectively regulate a supply of electrical power to the LEDs 126 to control operation of the LED-based light 216.

The LED-based light 216 can also incorporate one or more of the sensors 28, for example, and can incorporate a communications unit 42 for determining the location of other LED-based lights 216. For example, multiple LED-based lights 216 including a communications unit 42 can together form the spatially distributed network of communications units 42. The positions of one or more LED-based lights 216 including a communications unit 42 can be determined manually, with the positions of the remainder of the LED-based lights 16, 116 or 216 installed into the lighting control system 12 being determined according to the process and techniques described above. In this example, the LED-based light 216 also includes communications devices 44 and/or 46 for sending and receiving location signals $\gamma$, although the LED-based light 216 could also communicate with the lighting control system 12 through the communications channels of the communications link 40.

The LED-based lights described herein are presented as examples and are not meant to be limiting. The embodiments can be used with any lighting components known to those skilled in the art and compatible with the scope of the disclosure. In addition, the disclosed processes and techniques can be applied in a variety of building automation system implemented control systems to regulate environmental conditions other than lighting conditions. For example, the disclosed processes and techniques can be applied to determine the position of printers, alarm system components and/or HVAC components, and various controllers can be control operation of these components for purpose of regulating related environmental conditions of the building 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A lighting system comprising:

a first light source having a first communications device associated therewith, the first communications device being configured to transmit a location signal;

a control unit remote from the first light source, the control unit comprising a processor configured to:

store data regarding a plurality of physical areas, the data comprising, for each physical area:

a definition of the physical area, wherein the definition of the physical area comprises at least one of an indication of a functional characteristic of the physical area, an indication of a physical surrounding of the physical area, an indication of a presence of natural light in proximity to the physical area, or an indication of a constraint associated with the physical area, and an indication of a lighting condition associated with the physical area;

receive the first location signal;

determine that the first light source is positioned within a first physical area of the plurality of physical areas based on the location signal;

store an indication of an association between the first light source and the first physical area;

retrieve the indication of the lighting condition associated with the first physical area; and operate the first light source to satisfy the lighting condition associated with the first physical area, wherein operating the first light source comprises transmitting one or more command signals to the first communications device associated with the first light source.

2. A lighting system comprising:

a first light source having a first communications device associated therewith, the first communications device being configured to transmit a location signal;

a control unit remote from the first light source, the control unit comprising a processor configured to:

store data regarding a plurality of physical areas, the data comprising, for each physical area:

a definition of the physical area, and an indication of a lighting condition associated with the physical area;

receive the first location signal, wherein the indication of the lighting condition associated with the physical area comprises at least one of an indication of a lighting performance requirement associated with the physical area, an indication of a lighting efficiency requirement associated with the physical area, an indication of a safety lighting requirement associated with the physical area, or an indication of a comfort requirement associated with the physical area;

determine that the first light source is positioned within a first physical area of the plurality of physical areas based on the location signal;

store an indication of an association between the first light source and the first physical area;

retrieve the indication of the lighting condition associated with the first physical area; and operate the first light source to satisfy the lighting condition associated with the first physical area, wherein operating the first light source comprises transmitting one or more command signals to the first communications device associated with the first light source.

3. A lighting system comprising:

a first light source having a first communications device associated therewith, the first communications device being configured to transmit a location signal;

a control unit remote from the first light source, the control unit comprising a processor configured to:

store data regarding a plurality of physical areas, the data comprising, for each physical area:

a definition of the physical area, and an indication of a lighting condition associated with the physical area;

receive the first location signal;

determine that the first light source is positioned within a first physical area of the plurality of physical areas based on the location signal;

store an indication of an association between the first light source and the first physical area;

retrieve the indication of the lighting condition associated with the first physical area; and operate the first light source to satisfy the lighting condition associated with the first physical area, wherein operating the first light source comprises transmitting one or more command signals to the first communications device associated with the first light source, and modifying a brightness of the first light source to satisfy the lighting condition associated with the first physical area.

4. The lighting system of claim 3, wherein modifying the light output of the first light source comprises increasing the brightness of the first light source.

5. The lighting system of claim 3, wherein modifying the light output of the first light source comprises decreasing the brightness of the first light source.

6. The lighting system of claim 3, wherein operating the first light source further comprises:

receiving, at the control unit, sensor data from one or more sensors positioned in the first physical area, the sensor data indicating a current physical lighting condition of the first physical area;

determining, at the control unit, that the current physical lighting condition does not satisfy the lighting condition associated with the first physical area;

responsive to determining that the current physical lighting condition does not satisfy the lighting condition associated with the first physical area, modifying the brightness of the first light source to satisfy the lighting condition associated with the first physical area.

* * * * *